US006736075B2

(12) United States Patent
Jackson

(10) Patent No.: US 6,736,075 B2
(45) Date of Patent: May 18, 2004

(54) TRADE SHOW BOOTH

(75) Inventor: John D. Jackson, Waterloo, IN (US)

(73) Assignee: Technology Solutions Incorporated, Waterloo, IN (US)

( * ) Notice: Subject to any disclaimer, the term of this patent is extended or adjusted under 35 U.S.C. 154(b) by 0 days.

(21) Appl. No.: 10/113,446

(22) Filed: Apr. 1, 2002

(65) Prior Publication Data

US 2003/0183134 A1 Oct. 2, 2003

(51) Int. Cl.[7] ..... A47B 57/00
(52) U.S. Cl. ..... 108/64; 108/50.01
(58) Field of Search ..... 108/64, 50.01, 108/50.02, 23, 60, 61, 180, 153.1, 165; 52/36.5, 239; 312/111, 107, 108; 211/184

(56) References Cited

U.S. PATENT DOCUMENTS 2,970,874 A * 2/1961 Honeycutt et al. ..... 108/60
3,971,327 A * 7/1976 Critchett ..... 108/60
4,936,228 A * 6/1990 Capo-Bianco ..... 108/64
4,986,194 A * 1/1991 Bollman ..... 108/60
4,987,194 A * 1/1991 Maeda et al. ..... 525/314
5,522,324 A * 6/1996 van Gelder et al. ..... 108/50.02
5,544,593 A * 8/1996 Canfield et al. ..... 108/110
D382,975 S 8/1997 Bolton
5,655,822 A * 8/1997 Roberts et al. ..... 108/64
5,787,648 A * 8/1998 O'Malley ..... 108/50.01
6,325,343 B1 * 12/2001 Flagg ..... 248/174

FOREIGN PATENT DOCUMENTS

DE 3835191 * 7/1990

* cited by examiner

*Primary Examiner*—Jose V. Chen
(74) *Attorney, Agent, or Firm*—Brinks Hofer Gilson & Lione

(57) ABSTRACT

A trade show booth that includes a plurality of base members that are removably fastened in a geometric shape. A plurality of inner base members are removably fastened to the base members. At least one countertop is removably fastened to the base members and the inner base members. A plurality of vertical support members extend upwardly from the countertops. A plurality of top members are removably fastened to the upper ends of the vertical support members.

22 Claims, 7 Drawing Sheets

TRADE SHOW BOOTH

FIELD OF THE INVENTION

The present invention relates generally to trade show booths and more particularly, to a trade show booth that is capable of being quickly and easily assembled and disassembled without the need for tools.

BACKGROUND OF THE INVENTION

Trade shows provide opportunities for businesses, industries and other organizations to exchange information as well as promote and sell their respective goods or services. At these events, exhibitors offer promotional literature and goods to potential customers in an attempt to induce customers to purchase their goods or services. Exhibitors at these events compete with one another for the attention of potential customers for potential sales. Having a well designed booth that effectively catches the attention of potential customers is important to exhibitors and can have a direct impact on an exhibitor's sales at such events.

Many exhibitors attend several events throughout the year. Because many exhibitors travel to multiple events each year, many purchase their own display materials and move them from one event to another. Some exhibitors own their own display booths which must be assembled and disassembled at each event. Such booths enable the exhibitor to design the display ahead of time. Most booths or display materials must be placed in separate shipping containers and shipped to the location of a particular event. Once the containers arrive, the event personnel typically deliver the containers to the exhibitor at an assigned display area. Then, the exhibitors must assemble the display booth, which is extremely time consuming.

As such, a need exists for a display booth that is capable of being easily assembled and disassembled while at the same time having the capability of catching the attention of potential customers.

SUMMARY OF THE PRESENT INVENTION

A preferred embodiment of the present invention discloses a trade show booth that is capable of quickly and easily being assembled and disassembled while at the same time providing an eye catching look and feel to attract the attention of potential customers. In addition, the unique design provides a 360° exposure and ample counter space. In this embodiment, a plurality of base members are connected together to form a predetermined geometric shape. A plurality of inner base members are connected to the base members. The inner base members extend within the geometric shape thereby forming a plurality of countertop frames. Countertops are connected to each countertop frame. A plurality of vertical support members extend upwardly from each countertop and a plurality of top members are connected to each vertical support member.

In the preferred embodiment, the base members are removably connected to each other using a Velcro connection that is formed using a plurality of Velcro strips. The inner base members are also connected to the base members using a Velcro connection that is formed by the Velcro strips. A first support bracket is also preferentially used to connect respective ends of the inner base members to one another to provide further support for the countertops. A second support bracket is connected to the top edge of the inner base members such that the base members, the first support bracket and the second support brackets form countertop frames. The countertops are then connected to the countertop frames.

Each vertical support member is preferably removably connected to the second support brace. The vertical support members are connected to the second support brace using a Velcro connection that is formed by a female portion of Velcro on the vertical support members and a male or hook portion of Velcro on the second support bracket. Preferentially, a plurality of lighting devices are positioned within apertures located in the top member of the trade show booth. A plurality of signage pieces are also connected between each of the vertical support members.

Yet another preferred embodiment of the present invention discloses a method of creating trade show booth that includes a plurality of base members that are removably fastened together in a predetermined geometric shape. A plurality of inner base members are removably fastened to the base members. A countertop is removably fastened with the base members and the inner base members. A plurality of vertical support members are fastened with the inner base members and extend upwardly from the countertops to provide support for a plurality of top members that are removably fastened to the vertical support members in a shape that preferentially matches the geometric shape of the base members.

Further objects and advantages of the present invention will be apparent from the following description, reference being made to the accompanying drawings wherein preferred embodiments of the invention are clearly illustrated.

DETAILED DESCRIPTION OF THE PRESENT INVENTION

Figure 1:
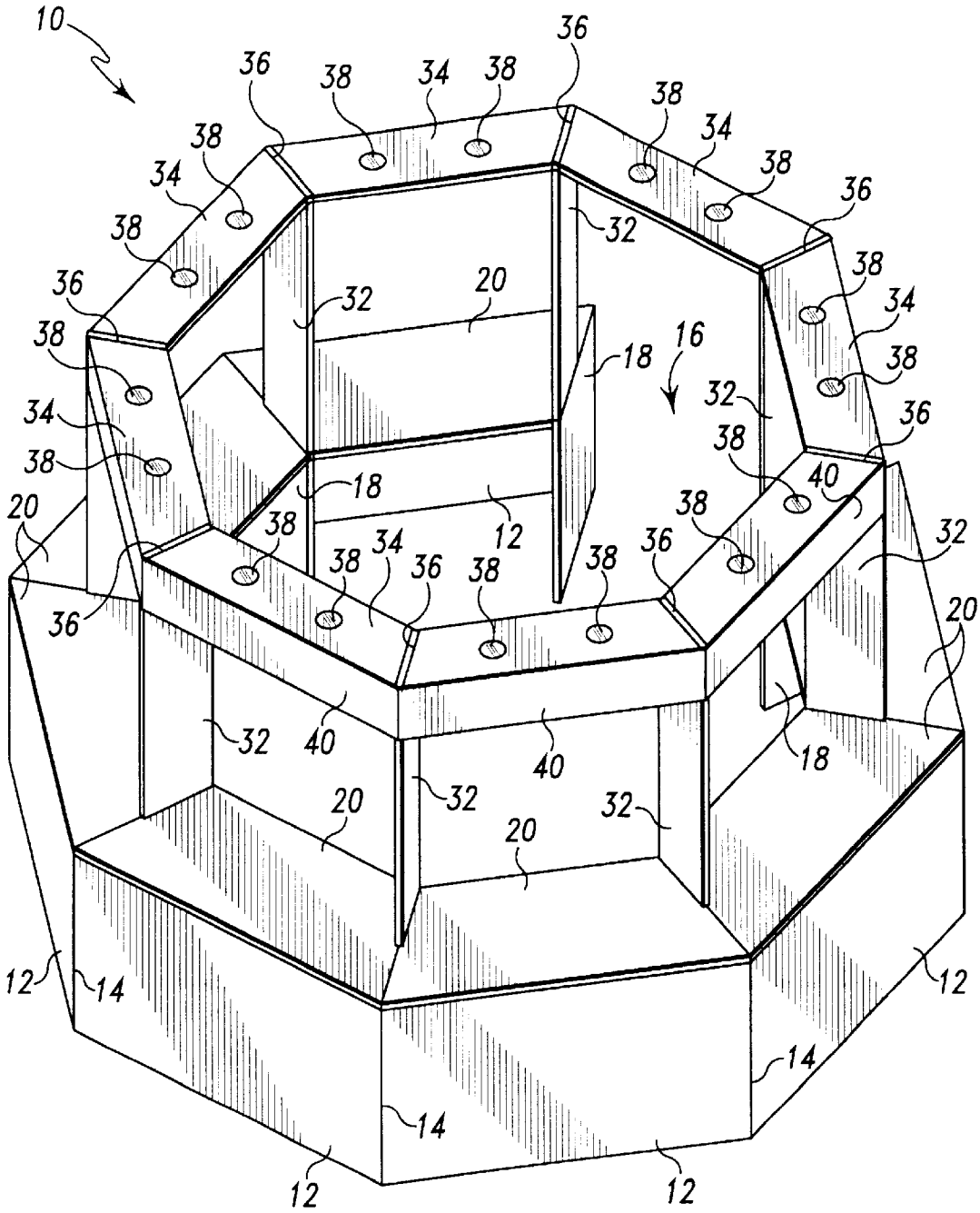
FIG. 1 is a perspective view of the preferred trade show booth.
Figure 2:
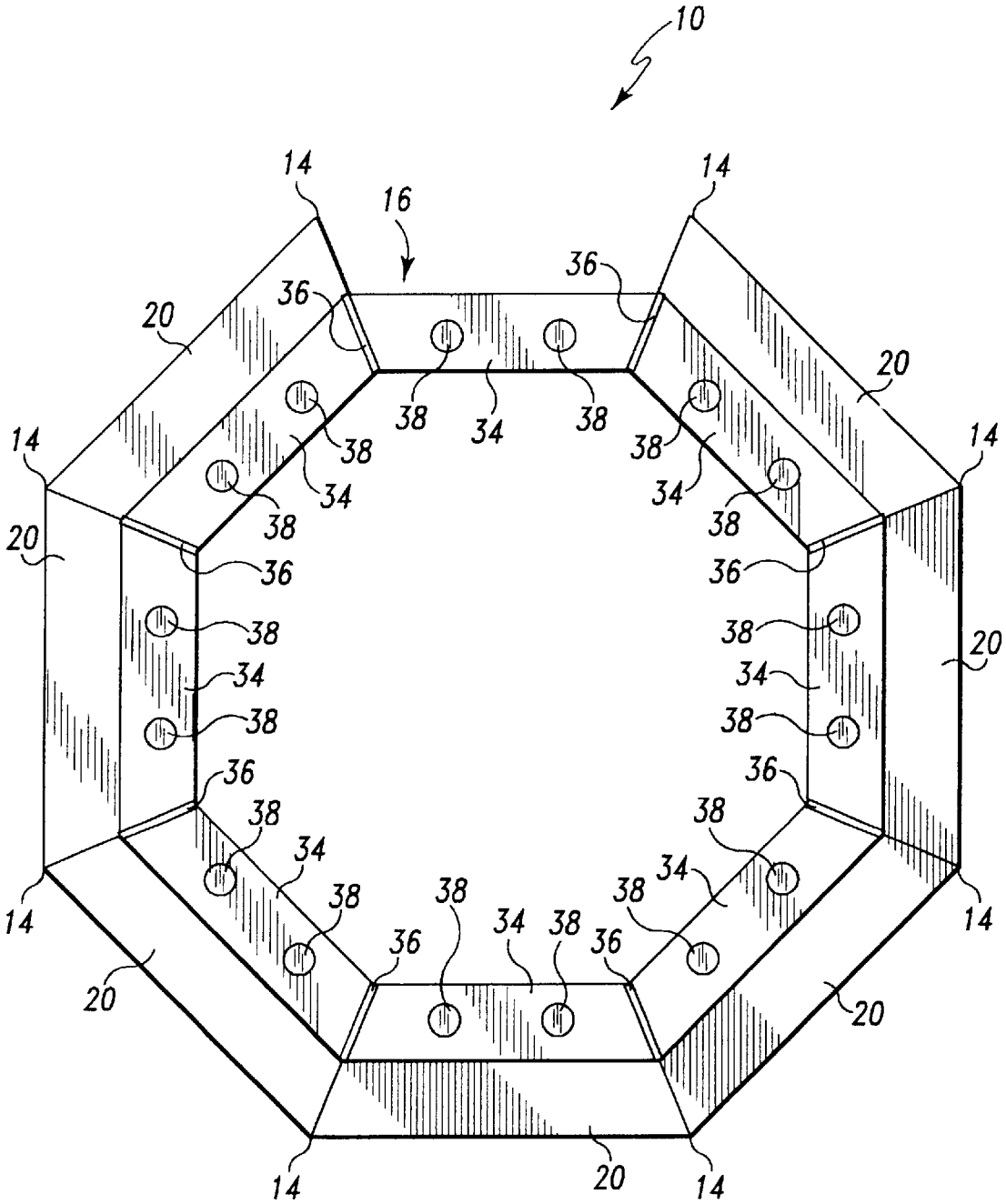
FIG. 2 is a top view of the preferred trade show booth.

Referring to FIGS. 1–5, the present invention discloses a trade show booth 10 that includes a plurality of rectangular shaped base members 12 that are interconnected or arranged to form a predetermined geometric shape. The preferred embodiment of the present invention illustrated in FIG. 1 discloses a trade show booth 10 that is formed in the geometric shape of an octagon. Although an octagon geometric shape is disclosed in the various figures, those skilled in the art should realize that other geometric shapes and configurations could be used such as a pentagon, for example. Therefore, the disclosure of an octagon trade show booth configuration should be viewed in an illustrative sense and should not be construed as a limitation of the present invention.

Although not specifically illustrated in FIGS. 1–5, in the preferred embodiment of the present invention the base members 12 are removably fastened together on the inside using a Velcro strip when the trade show booth 10 is assembled. A Velcro strip is used because of the ease and speed in which it may be applied and removed from the base members 12. The preferred base members 12 are made using a corrugated plastic sheet that has been covered with an aluminum skin that is sold under the Econolite trademark. This material is strong and light weight thereby minimizing the weight of the trade show booth 10.

In the preferred embodiment, a thin piece of carpet is adhered to the sheets of Econolite to allow Velcro pieces to readily stick to the base members 12. The base members 12 are preferentially held together by placing Velcro strips along a connection point 14 that is formed by the mating of the edges of respective base members 12. Approximately half of the width of the Velcro strip is placed on one edge of a respective base member 12 and the other half is placed on an edge of a respective second base member 12. The edges of the base members 12 are preferentially designed to appear flush when they are placed together at the connection point 14. An entrance 16 is preferably formed in the trade show booth 10 by removing one of the respective sides or base members 12 of the geometric shape.

Figure 3:
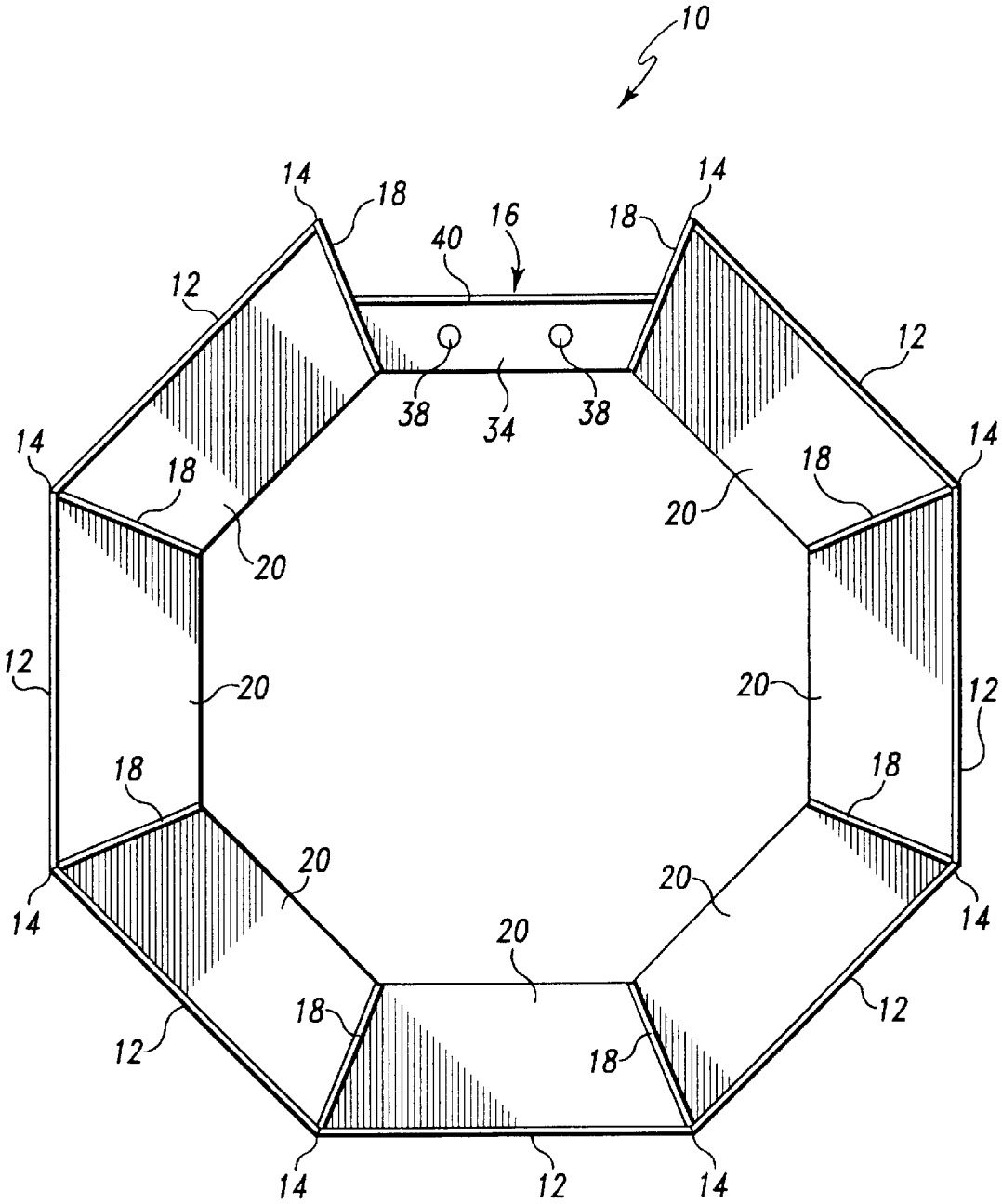
FIG. 3 is a bottom view of the preferred trade show booth.
Figure 4:
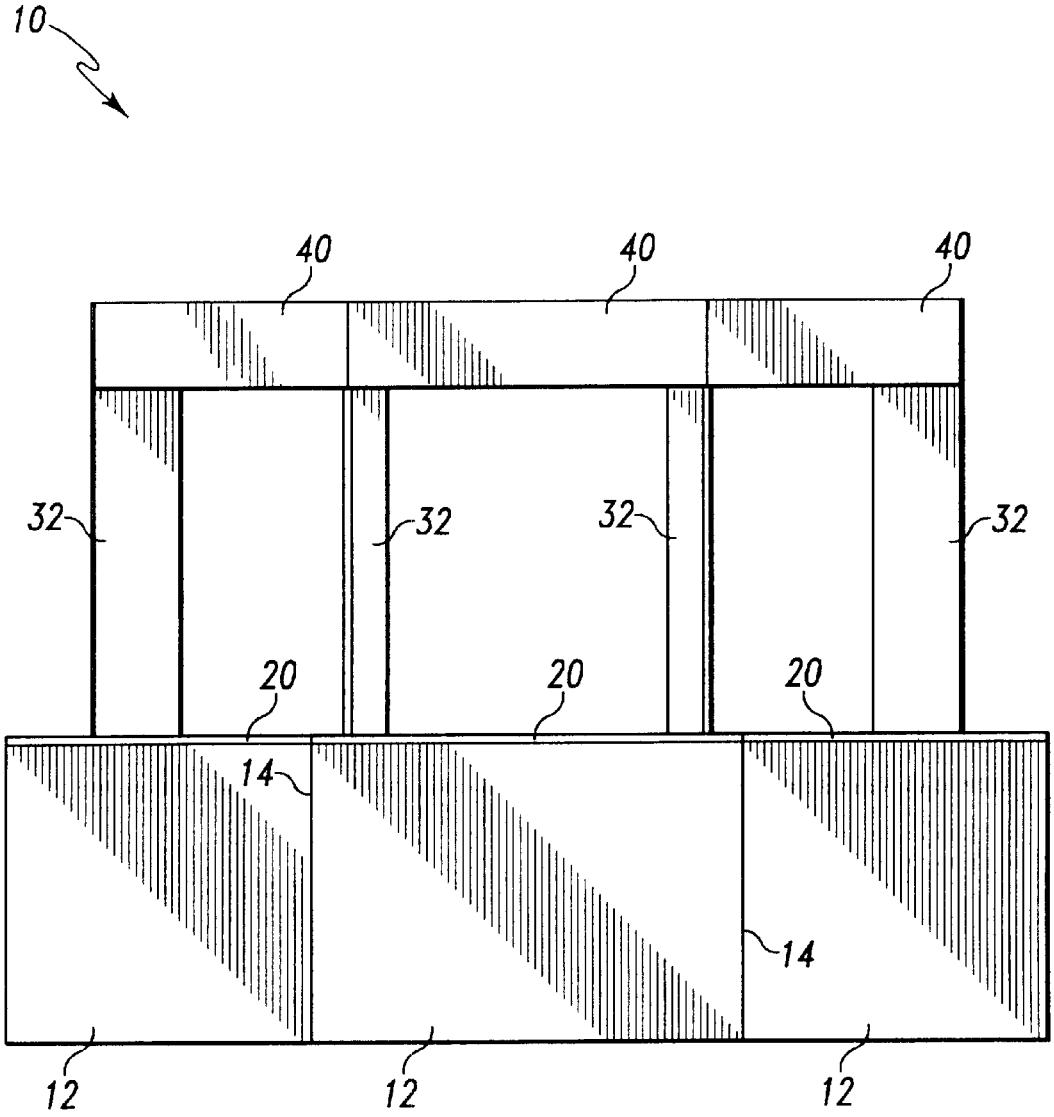
FIG. 4 is a side view of the preferred trade show booth.
Figure 5:
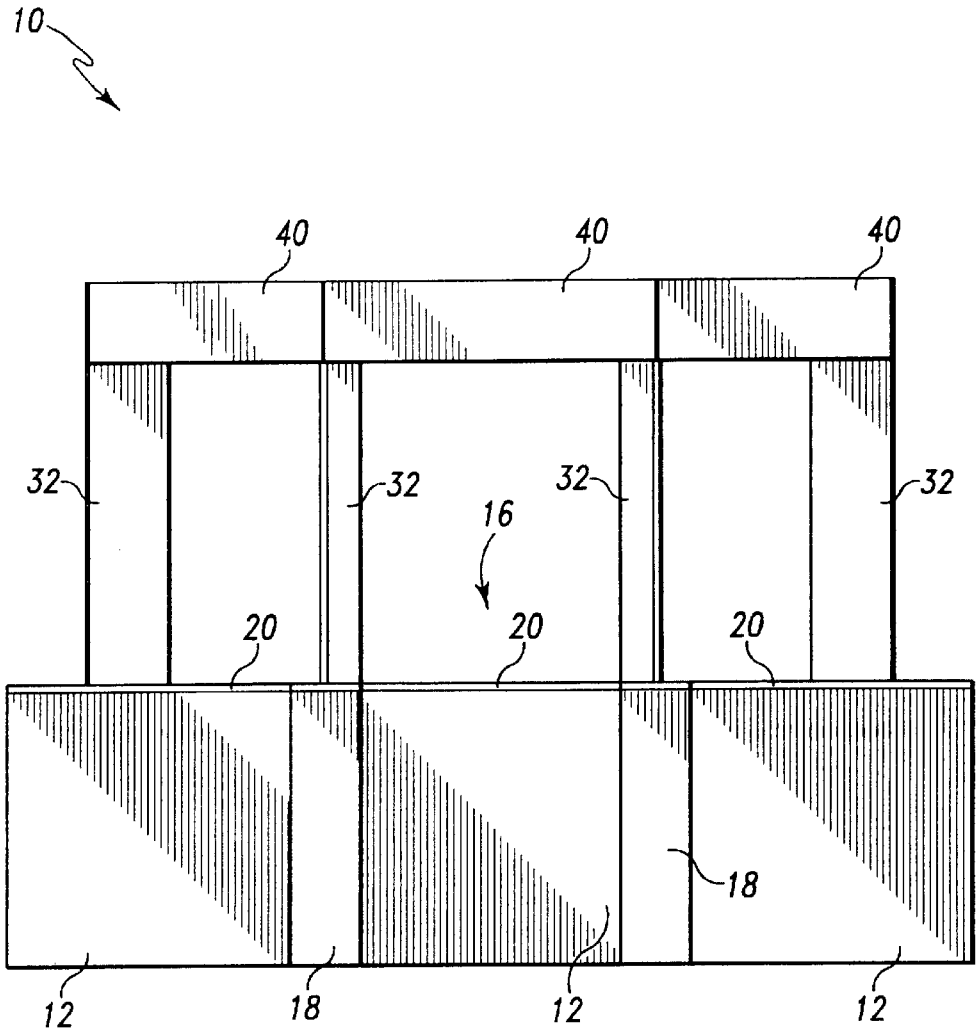
FIG. 5 is another side view of the preferred trade show booth illustrating the entrance of the preferred trade show booth.

Referring to FIGS. 1 and 3, a plurality of rectangular-shaped inner base members 18 are also connected to the connection point 14 of the base members 12. The inner base members 18 extend inwardly from the outer portion of the geometric shape formed by the base members 12 as illustrated. The inner base members 18 are constructed similarly to the base members 12. Preferentially, the Velcro strips that are used to connect the base members 12 together are also used to secure the inner base members 18 to the base members 12. The backside of the Velcro strip is provided with the female or loop portion of Velcro and a male or hook portion of the Velcro is placed on the edge of the inner base members 18. This is actually done by having the male or hook portion on the backside of the Velcro strip. The base unit 18 has carpet that extends from one side to the other, thus covering the end. Therefore, this could be achieved either way. As such, when the edge of the inner base members 18 are placed against the back side of the Velcro strip it causes the inner base members 18 to become fastened to the base members 12 at the connection points 14.

Figure 6:
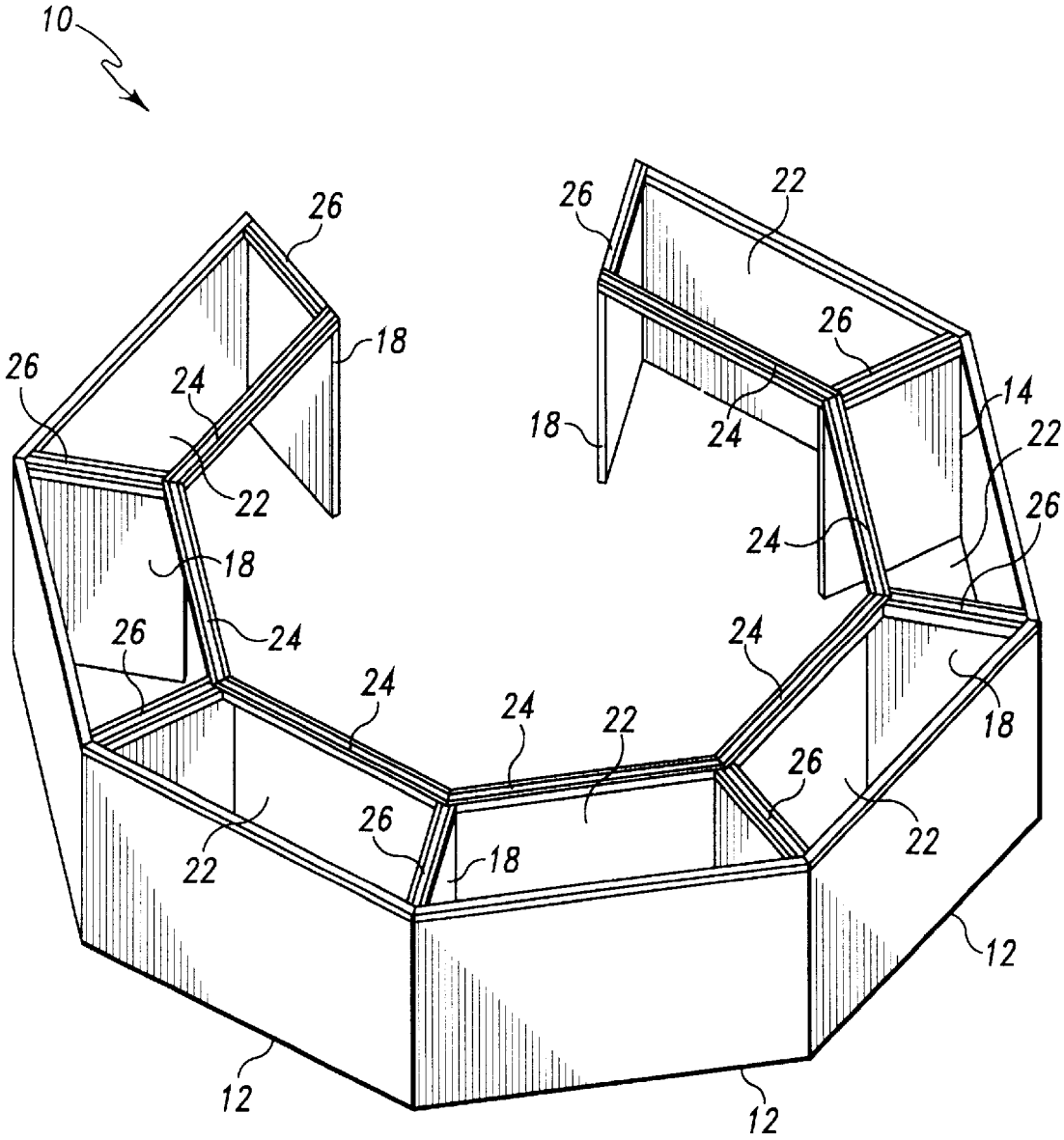
FIG. 6 illustrates the preferred countertop frames of the trade show booth.

Referring once again to FIGS. 1–5, a plurality of countertops 20 are connected to a countertop frame 22 (see FIG. 6) that is formed in part by an upper edge of the base member 12 and an upper edge of the inner base member 18. Referring to FIG. 6, the countertop frames 22 of the trade show booth 10 are illustrated and include a first support bracket 24 and a second support bracket 26. The first support bracket 24 extends between respective inner base members 18 and is connected to an outer edge of the inner base members 18, preferentially using Velcro strips attached to the underside of an edge of the first support bracket 24. Although not illustrated, a male or hook portion of a Velcro strip is also preferentially adhered to an upper surface of the first support member 24 to secure the countertops 20 to the first support bracket 24.

Figure 7:
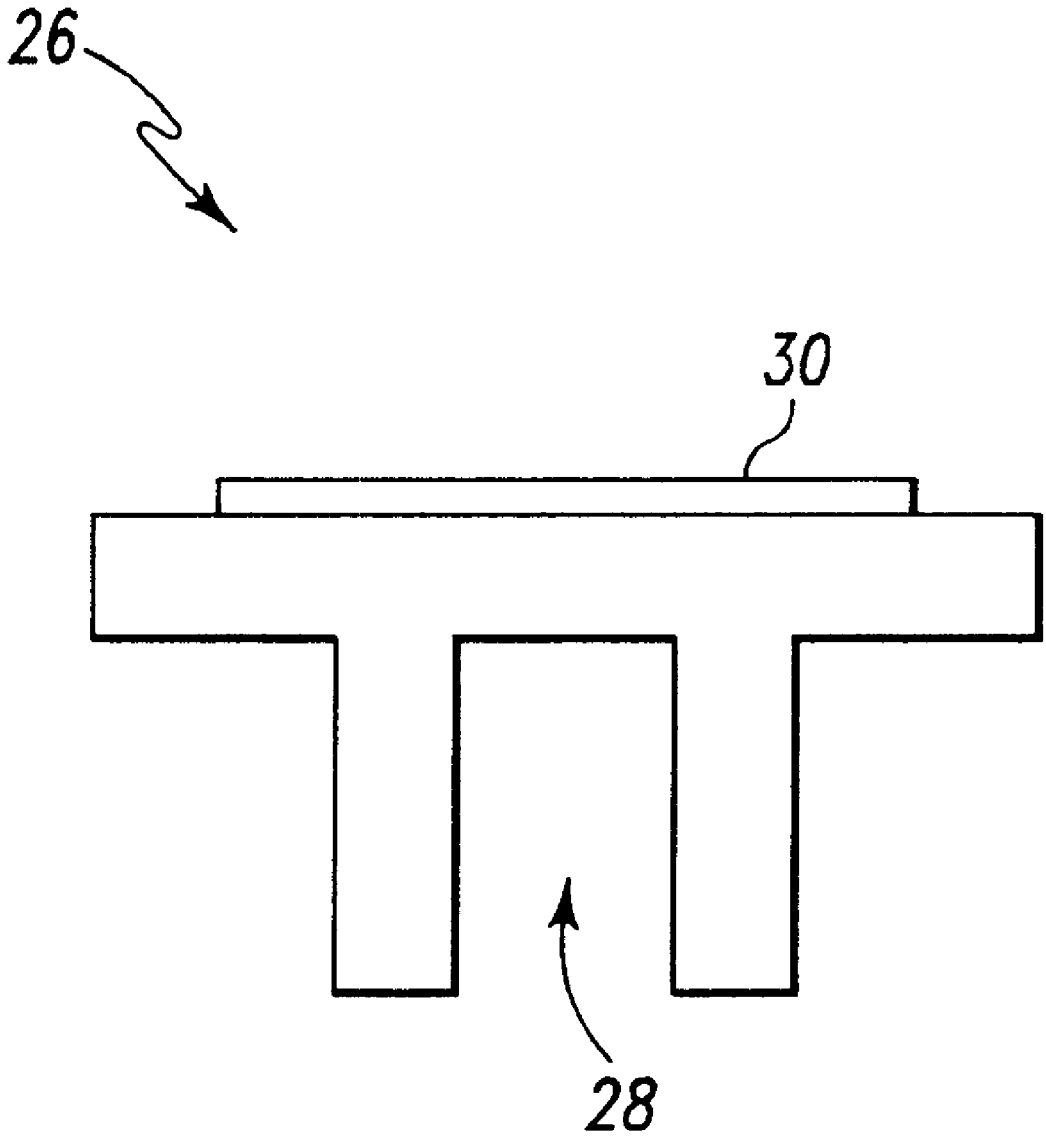
FIG. 7 is a cross-sectional view of a support bracket.

Referring to FIG. 7, a cross-section of the second support bracket 26 is illustrated to demonstrate the manner in which the second support bracket 26 connects to the upper edge of a portion of the inner base member 18. The second support bracket 26 includes a U-shaped notch 28 that provides a friction fit over the upper edge of the inner base member 18. The male or hook portion of a Velcro strip 30 is adhered to the upper surface of the second support bracket 26. The first support bracket 24 can be made of a material similar in shape to the second support bracket 26, but can also be made of other similar shaped materials as well.

Referring once again to FIGS. 1–6, a countertop 20 is connected to the countertop frame 22 that is formed by a combination of the upper edge of the base member 12, the first support bracket 24 and the second support brackets 26. The preferred countertops 20 are formed in the shape of a trapezoid. Although not specifically illustrated, the male or hook portion of a Velcro strip is also connected to the upper edge of the base member 12. As such, the male portions of Velcro strips on the first support bracket 24, the second support brackets 26 and the base member 12 are fastened to a female or loop portion of at least one Velcro strip that has been adhered to the underside of the countertops 20. The countertops 20 are thereby preferentially entirely held in position using Velcro strips thereby allowing the countertops 20 to be quickly and easily placed and removed from position. The preferred countertops 20 are made using an acrylic or plastic material; however other materials may be used as well.

As illustrated, a plurality of vertical support members 32 extend upwardly in relation to the countertops 20. The vertical support members 32 are preferentially located toward an inside edge of the inner base members 18. Although not specifically illustrated, the preferred countertops 20 are provided with a notched section on their outer edges that allows a bottom edge of the vertical support members 32, which are covered with female or loop portions of Velcro, to be connected to the upper surface of the first and second support brackets 24, 26. The male or hook portion of the Velcro strips on the first and second support brackets 24, 26 allows the vertical support members 32 to be fastened to the first and second support brackets 24, 26. The notched section in the countertops 20 allows the vertical support members 32 to appear flush with the countertops 20. This notched out section prevents the vertical support members 32 from shifting. The preferred vertical support members 32 are made the same as the base members 12 and the inner base members 18.

A plurality of top members 34 are connected to an upper edge of the respective vertical support members 32 to form a geometric shape almost identical to the geometric shape formed by the arrangement of the base members 12. Although not illustrated, the male or hook portion of a Velcro strip is connected to an upper edge of the vertical support members 32. When a top member 34 is placed in contact with the Velcro strip it causes the top member 34 to be removably fastened to the upper edge of the vertical support member 32. A Velcro strip 36 is connected to the upper surface of the top members 34 at junction points where the top members 34 mate together. The top members 34 are preferentially made using the same material that is used to make the base members 12, the inner base members 18 and the vertical support members 32.

In the preferred embodiment of the present invention, a plurality of lighting devices 38 are inserted into apertures (not illustrated) that are located in each respective top member 34. The apertures are sized such that the lighting devices 38 snap into the apertures and remain in place through a friction fit. The lighting devices 38 may be battery operated or powered from conventional AC power sources. If an AC power source is used, although not illustrated, preferentially a Velcro strip is used to conceal the power cords as they are taken down to the power source by placing the power cords and the strips on a back edge of the vertical support members 32. In the preferred embodiment of the present invention the lighting devices 38 are halogen lights.

As further illustrated, a plurality of signage pieces 40 are connected to the vertical support members 32 and the top members 34. The signage piece 40 extends between respective vertical support members 32. Although not specifically illustrated, the male or hook portion of a Velcro strip is adhered to the outer edges and the upper edge of the signage piece 40 to fasten the signage piece 40 to vertical support members 32 and the top members 34.

The trade show booth 10 disclosed herein is capable of being quickly and easily assembled and disassembled without the need of any tools. At the same time, the trade show booth 10 provides an extremely attractive look and feel that is capable of attracting potential customers.

While the invention has been described in its currently best-known modes of operation and embodiments, other modes, embodiments and advantages of the present invention will be apparent to those skilled in the art and are contemplated herein.

What is claimed is:

1. A trade show booth, comprising:

a plurality of base members connected together in a geometric shape to form a partially enclosed cavity;

a plurality of inner base members connected to said base members, wherein said inner base members extend within said enclosed cavity;

a predetermined number of first support brackets connected to a portion of an upper edge of said inner base members, a predetermined number of second support brackets connected to a second portion of said upper edge of said inner base members at an outer edge of said inner base members where said inner base members extend within said enclosed cavity, wherein said second support brackets extend between respective inner base members, wherein said base members, said inner base members, said first support bracket and said second support bracket form a countertop frame;

a countertop connected to each said countertop frame;

a plurality of vertical support members connected to said first support brackets, wherein said vertical support members extending upwardly from each said countertop; and a plurality of top members connected to an upper edge of each said vertical support memeber.

2. The trade show booth of claim 1, wherein said base members are removably connected to each other.

3. The trade show booth of claim 2, wherein said base members are removably connected using a Velcro strip.

4. The trade show booth of claim 1, wherein said inner base members are connected to said base members using a Velcro strip.

5. The trade show booth of claim 1, further comprising an entrance formed by not placing a base member on at least one side of the enclosed cavity.

6. The trade show booth of claim 1, wherein each said countertop is connected to said countertop frame using a Velcro connection.

7. The trade show booth of claim 1, wherein each said vertical support member is removably connected to said second support brace.

8. The trade show booth of claim 2, wherein said vertical support member is connected to said second support brace using a Velcro connection.

9. The trade show booth of claim 1, further comprising at least one lighting device connected to said top member.

10. The trade show booth of claim 1, further comprising at least one signage piece connected between a predetermined number of said vertical support members.

11. A trade show booth, comprising:

a plurality of base members removably fastened together in a geometric shape to form a partially enclosed cavity;

a plurality of inner base members removably fastened to said base members, wherein said inner base members extend within said partially enclosed cavity;

a first support bracket connected to a portion of an upper edge of each of the inner base members and a second support bracket connected to a second portion of the upper edge of the inner base members at an outer edge of the inner base members, wherein each said second support bracket extends between respective inner base members;

a countertop removably connected with a predetermined number of said base members, said first support brackets and said second support brackets;

a plurality of vertical support members removably connected with said first support bracket and extending upwardly from said countertops; and a plurality of top members removably fastened to said vertical support members.

12. The trade show booth of claim 11, further comprising at least one signage piece removably connected to said vertical support members.

13. The trade show booth of claim 12, wherein said at least one signage piece is removably connected to said vertical support members using a Velcro connection.

14. The trade show booth of claim 12, wherein said at least one signage piece is removably connected to a bottom surface of said top member using a Velcro connection.

15. The trade show booth of claim 11, further comprising at least one lighting device positioned within an aperture located on said top member.

16. The trade show booth of claim 11, wherein said base members are removably connected in said predetermined geometric shape using a plurality of Velcro connections.

17. The trade show booth of claim 11, wherein said inner base members are removably fastened to said base members using a Velcro connection.

18. The trade show booth of claim 11, wherein said countertops are removably fastened to said base members using a Velcro connection.

19. The trade show booth of claim 11, wherein said countertop is removably fastened to said first and second support brackets using a Velcro connection.

20. The trade show booth of claim 11, wherein said vertical support members are removably connected to said first support bracket using a Velcro connection.

21. The trade show booth of claim 11, wherein said top members are removably fastened to said vertical support members using a Velcro connection.

22. A method of creating a trade show booth, comprising the steps of:

fastening a plurality of base members in a geometric shape to form a partially enclosed cavity using Velcro connections;

fastening a plurality of inner base members to a predetermined number of said base members using a Velcro connection;

connecting a first support bracket to a portion of an upper edge of a predetermined number of said inner base members;

fastening a second support bracket to a second portion of the upper edge of respective inner base members, wherein said second support bracket extends between respective inner base members, wherein said base members, said first support bracket and said second support bracket form a countertop frame;

fastening a countertop to each said countertop frame using a Velcro connection;

fastening a vertical support member to a portion of said first support bracket using a Velcro connection; and fastening a plurality of top members to an upper portion of said vertical support members using a Velcro connection.

* * * * *